US009577313B2

(12) United States Patent
Nielsen

(10) Patent No.: US 9,577,313 B2
(45) Date of Patent: Feb. 21, 2017

(54) PEDESTAL FOR TRACKING ANTENNA

(71) Applicant: SpaceCom Holding ApS, Hobro (DK)

(72) Inventor: Peter Troels Nielsen, Hobro (DK)

(73) Assignee: SpaceCom Holding ApS, Hobro (DK)

( * ) Notice: Subject to any disclaimer, the term of this patent is extended or adjusted under 35 U.S.C. 154(b) by 7 days.

(21) Appl. No.: 14/361,119

(22) PCT Filed: Dec. 6, 2012

(86) PCT No.: PCT/EP2012/005020

§ 371 (c)(1),
(2) Date: May 28, 2014

(87) PCT Pub. No.: WO2013/083272

PCT Pub. Date: Jun. 13, 2013

(65) Prior Publication Data

US 2014/0299734 A1 Oct. 9, 2014

(30) Foreign Application Priority Data

Dec. 8, 2011 (DK) ..... 2011 00953

(51) Int. Cl.
*H01Q 1/34* (2006.01)
*H01Q 1/00* (2006.01)
(Continued)

(52) U.S. Cl.
CPC ..... *H01Q 1/18* (2013.01); *H01Q 1/005* (2013.01); *H01Q 1/12* (2013.01); *H01Q 1/34* (2013.01); *H01Q 3/08* (2013.01)

(58) Field of Classification Search
CPC ..... H01Q 1/005; H01Q 1/34; H01Q 1/18; H01Q 3/08; H01Q 1/3275; H01Q 1/1207
(Continued)

(56) References Cited

U.S. PATENT DOCUMENTS 2,415,680 A * 2/1947 Hoyt ..... H01Q 3/08 318/282
4,994,816 A * 2/1991 Kondo ..... H01Q 15/162 343/762
(Continued)

FOREIGN PATENT DOCUMENTS

EP 0855092 1/2001
EP 1812992 4/2008
(Continued)

*Primary Examiner* — Jonathan Liu
*Assistant Examiner* — Muhammad Ijaz
(74) *Attorney, Agent, or Firm* — K. David Crockett, Esq.; Niky Economy Syrengelas, Esq.; Crockett & Crockett, PC

(57) ABSTRACT

There is provided a three-axes pedestal for stabilizing the pointing of a mobile tracking antenna. The pedestal comprises a base support with an azimuth axis support having a centerline defining a first axis or azimuth axis, and a first frame being rotatably mounted on the azimuth axis support to rotate about the first axis, where the first frame may hold at least part of a first horizontal linear bearing assembly. The pedestal further comprises a second frame with a lower frame part, which may be slidably interconnected to the first frame via the first horizontal linear bearing assembly. The first linear bearing assembly may include dampers or suspension members for dampening linear slide movement of the second frame along the first linear bearing assembly and thereby for dampening the relative movement of the second frame to the first frame. The pedestal also comprises a third frame interconnected to an upper part of the second frame, where the third frame holds a cross-elevation axis support with a centerline defining a second axis or cross-elevation axis. Furthermore, the pedestal comprises a fourth frame being rotatably mounted on the cross-elevation axis support of the third frame to rotate about the second axis, where the fourth frame holds an elevation axis support with a centerline defining a third axis or elevation axis. The pedestal also
(Continued)

comprises a fifth frame supporting the tracking antenna, which fifth frame is rotatably mounted on the elevation axis support of the fourth frame to rotate about the third axis. The upper part of the second frame may hold a second linear bearing assembly, with the third frame being interconnected to the second frame via the second linear bearing assembly, and with the second linear bearing assembly providing a direction of linear slide movement and an axis of rotation for the third frame, thereby providing an axis of rotation for the second axis in a plane perpendicular to the direction of linear slide movement provided by the second linear bearing assembly.

23 Claims, 10 Drawing Sheets

(51) Int. Cl.
*H01Q 1/18* (2006.01)
*H01Q 3/08* (2006.01)
*H01Q 1/12* (2006.01)

(58) Field of Classification Search
USPC ..... 248/88, 560, 583, 671, 661, 130, 131,248/913; 343/765, 758, 761, 823
See application file for complete search history.

(56) References Cited

U.S. PATENT DOCUMENTS 5,075,682 A * 12/1991 Dehnert ..... 342/352
5,419,512 A 5/1995 Holzschuh et al.
5,419,521 A * 5/1995 Matthews ..... F16M 11/10 248/179.1
5,517,204 A * 5/1996 Murakoshi ..... H01Q 1/18 248/183.1
5,646,638 A * 7/1997 Winegard ..... H01Q 3/02 343/840
6,734,830 B1 * 5/2004 Bickham ..... H01Q 1/1221 248/910
7,446,721 B2 11/2008 Eom
7,508,342 B2 3/2009 Nelson
7,557,764 B2 * 7/2009 Krajicek ..... H01Q 1/3275 343/713
7,663,565 B2 2/2010 Son et al.
2006/0038728 A1 * 2/2006 McEwan ..... H01Q 1/084 343/713
2008/0297427 A1 * 12/2008 Jung ..... H01Q 1/1257 343/766
2009/0231224 A1 * 9/2009 Felstead et al. ..... 343/766
2009/0262033 A1 * 10/2009 King ..... H01Q 1/088 343/713
2010/0149059 A1 * 6/2010 Patel ..... H01Q 1/005 343/765
2011/0068989 A1 * 3/2011 Bousquet ..... H01Q 3/02 343/761
2012/0268333 A1 * 10/2012 Lucidarme ..... H01P 1/161 343/763
2014/0299734 A1 * 10/2014 Nielsen ..... H01Q 1/005 248/560
2015/0054703 A1 * 2/2015 Yano ..... H01P 1/064 343/762

FOREIGN PATENT DOCUMENTS

JP 0294801 4/1990
WO WO9305363 3/1993
WO WO2007046589 4/2007

* cited by examiner

PEDESTAL FOR TRACKING ANTENNA

FIELD OF THE INVENTION

The present invention relates to antenna pedestals and particularly to satellite tracking antenna pedestals used on ships and other mobile applications.

BACKGROUND OF THE INVENTION

The invention is especially suitable for use aboard ship wherein an antenna is operated to track a transmitting station, such as a communications satellite, notwithstanding roll, pitch, yaw, and turn motions of a ship at sea.

Antennas used in shipboard satellite communication terminals typically are highly directive. For such antennas to operate effectively they must be pointed continuously and accurately in the direction toward the satellite.

When a ship changes its geographical position, or when the satellite changes its position in orbit, and when the ship rolls, pitches, yaws and turns, an antenna mounted on the ship will tend to become misdirected. In addition to these disturbances the antenna will be subjected to other environmental stresses such as shocks caused by wave pounding. All of these effects must be compensated for so that the antenna pointing can be accurately directed and maintained in such direction.

Cost, compactness in size and lightness in weight are of paramount importance for antenna pedestals used on ships. Small ships and boats which operate in rough seas routinely experience roll amplitudes of +/−35 degrees or more, pitch amplitudes of +/−15 degrees, and repetitive wave pounding shocks of 5 g's or more. Antenna pedestals which are compact and light yet rugged are highly desired.

U.S. Pat. No. 5,419,521 discloses a three-axes pedestal for a tracking antenna. While this pedestal is quite effective, additional stabilization may be necessary, for example, during extremely rough seas and gale force winds.

U.S. Pat. Appl. No. 2010/0149059 discloses an improved three-axes pedestal for a tracking antenna. This pedestal includes horizontal and vertical vibration isolation components to better isolate the antenna from vibration and shock received by the base of the pedestal. However, the servo systems required to control the angular position of the antenna mounted on this pedestal is rather complex and sensitive to imperfect balance, bearing friction and imposed vibration and shock.

It would therefore be useful to provide an improved pedestal for a tracking antenna having shock and vibration isolation components allowing the position of the tracking antenna to be controlled by relatively simple servo systems and by use of simple stepper motors and a servo mechanism that is much less sensitive to imperfect balance, bearing friction and imposed vibration and shock.

SUMMARY OF THE INVENTION

According to the present invention there is provided a three-axes pedestal for stabilizing the pointing of a mobile tracking antenna, said pedestal comprising:

- a base support with an azimuth axis support having a centerline defining a first axis or azimuth axis;
- a first frame being rotatably mounted on the azimuth axis support to rotate about the first axis;
- a second frame with a lower frame part interconnected to the first frame;

- a third frame interconnected to an upper part of the second frame, said third frame holding a cross-elevation axis support with a centerline defining a second axis or cross-elevation axis;
- a fourth frame being rotatably mounted on the cross-elevation axis support of the third frame to rotate about the second axis, said fourth frame holding an elevation axis support with a centerline defining a third axis or elevation axis; and
- a fifth frame supporting the tracking antenna and being rotatably mounted on the elevation axis support of the fourth frame to rotate about the third axis. It is preferred that the first frame holds at least part of a first horizontal linear bearing assembly, and that a lower frame part of the second frame is slidably interconnected to the first frame via the first horizontal linear bearing assembly, said first linear bearing assembly including dampers or suspension members for dampening linear slide movement of the second frame along the first linear bearing assembly and thereby for dampening the relative movement of the second frame to the first frame.

Thus, according to the present invention there is also provided a three-axes pedestal for stabilizing the pointing of a mobile tracking antenna, said pedestal comprising:

- a base support with an azimuth axis support having a centerline defining a first axis or azimuth axis;
- a first frame being rotatably mounted on the azimuth axis support to rotate about the first axis, said first frame holding at least part of a first horizontal linear bearing assembly;
- a second frame with a lower frame part slidably interconnected to the first frame via the first horizontal linear bearing assembly, said first linear bearing assembly including dampers or suspension members for dampening linear slide movement of the second frame along the first linear bearing assembly and thereby for dampening the relative movement of the second frame to the first frame;
- a third frame interconnected to an upper part of the second frame, said third frame holding a cross-elevation axis support with a centerline defining a second axis or cross-elevation axis;
- a fourth frame being rotatably mounted on the cross-elevation axis support of the third frame to rotate about the second axis, said fourth frame holding an elevation axis support with a centerline defining a third axis or elevation axis; and
- a fifth frame supporting the tracking antenna and being rotatably mounted on the elevation axis support of the fourth frame to rotate about the third axis.

It is preferred that the direction of the linear slide movement of the second frame along the first linear bearing assembly is substantially perpendicular to the first axis.

According to an embodiment of the invention the upper part of the second frame holds a second linear bearing assembly, and the third frame is slidably interconnected to the second frame via the second linear bearing assembly, with the second linear bearing assembly providing a direction of linear slide movement for the third frame. Here, the cross-elevation axis support may be arranged on the third frame so that the direction of the linear slide movement of the third frame provided by the second linear bearing assembly is substantial perpendicular to the second axis. It is preferred that the third frame is both slidably and rotatably interconnected to the second linear bearing assembly with the second linear bearing assembly providing an axis for rotation of the third frame and the second axis in a plane perpendicular to the direction of the linear slide movement provided by the second linear bearing assembly.

It is within an embodiment of the invention that the upper part of the second frame holds a second linear bearing assembly, with the third frame being interconnected to the second frame via said second linear bearing assembly, and with the second linear bearing assembly providing a direction of linear slide movement and an axis of rotation for the third frame, thereby providing an axis of rotation for the second axis in a plane perpendicular to the direction of linear slide movement provided by the second linear bearing assembly.

It is preferred that the direction of linear movement of the third frame along the second linear bearing assembly is substantially perpendicular to the direction of linear movement of the second frame along the first linear bearing assembly.

According to one or more embodiments of the invention the second linear bearing assembly is a horizontal linear bearing assembly, and the direction of linear movement along the second linear bearing assembly is substantially perpendicular to the first axis.

The present invention also covers one or more embodiments, wherein the pedestal further comprises a sub frame interconnecting the third frame and the second linear bearing assembly, said sub frame being slidably and rotatably connected to the second linear bearing assembly to provide the slidably and rotatably interconnection of the third frame to the second linear bearing assembly. Here, the third frame may be rotatably mounted to the sub frame for rotation about a vibration isolation axis being parallel to the rotation axis provided by the second linear bearing assembly. The sub frame may comprise one or more bearing connectors being slidably and rotatably mounted to the second linear bearing assembly, and the third frame may be rotatably mounted to the one or more bearing connectors to rotate about said vibration isolation axis.

The present invention also covers one or more embodiments, wherein the pedestal further comprises a vibration isolation assembly interconnecting the second frame and the third frame. Here, the vibration isolation assembly may comprise a dampening and/or suspension member with the second and third frames being connected via said dampening or suspension member. The dampening or suspension member interconnecting the second and third frames may be of a wire rope type, which thereby may isolate the third frame from vibration/shock of the base and first frame.

According to an embodiment of the invention the first linear bearing assembly comprises two elongated and parallel and horizontally arranged sliding guides or rails received within complementary shaped sliding openings of the lower part of the second frame.

It is preferred that the dampers of the first linear bearing assembly include one or more damping springs. Here, two damping springs may be arranged on at least one of the sliding guides of the first linear bearing assembly, with one on each side of the sliding opening of the lower frame part of the second frame.

The present invention also covers one or more embodiments wherein the base support further holds a first driven gear or pulley arranged concentric about the first axis or azimuth axis, and the first frame further holds an azimuth-axis drive motor operably connected to the driven gear or pulley.

For embodiments holding a second linear bearing assembly, the second linear bearing assembly may comprise an elongated and horizontally arranged sliding and rotation guide or rail fixedly mounted on the upper part of the second frame.

According to one or more embodiments of the invention the fourth frame holds a second driven gear or pulley arranged concentric about the second axis or cross-elevation axis, and the third frame holds a cross-elevation-axis drive motor operably connected to the second driven gear or pulley.

The present invention also covers one or more embodiments wherein the fifth frame holds a third driven gear or pulley arranged concentric about the third axis or elevation axis, and the fourth frame comprises an elevation-axis drive motor operably connected to the third driven gear or pulley.

Thus, the present invention provides embodiments of a pedestal for a tracking antenna, wherein vibration or shock movements imposed on the pedestal may be absorbed by linear or rotational movements or by a combination of linear and rotational movements of the frame structures relative to each other and irrespective of the direction(s) of the imposed vibration, whereby the direction and hence the pointing of the second and third axes will not be affected.

By use of a pedestal according to one or more embodiments of the present invention, stabilizing the pointing of a mobile tracking antenna can be obtained with simple stepper motors driving frame rotation about the three pedestal axes, wherein relatively simple servo systems can be used to control the stepper motors in a closed loop arrangement without causing cycle slip of the stepper motors. Direct control of angular position of the antenna may be enabled by use of a transfer function of lowest or a relatively low order in the servo systems.

By using a pedestal according to the principles of the present invention, friction of bearings and transmission elements should not affect the accuracy of the servo systems for stabilizing the pointing of the antenna. Also imperfect balance of the masses rotating about the azimuth, elevation and cross-elevation axis should not affect the accuracy of the servo systems. Furthermore, the degree of damping of the sliding and rotational movements of the frame structures relative to each other should easily be controlled by friction in linear bearings and dampening in the rope type damper.

The invention will now be described in further details with reference to the accompanying drawings.

DETAILED DESCRIPTION OF THE INVENTION

Figure 1:
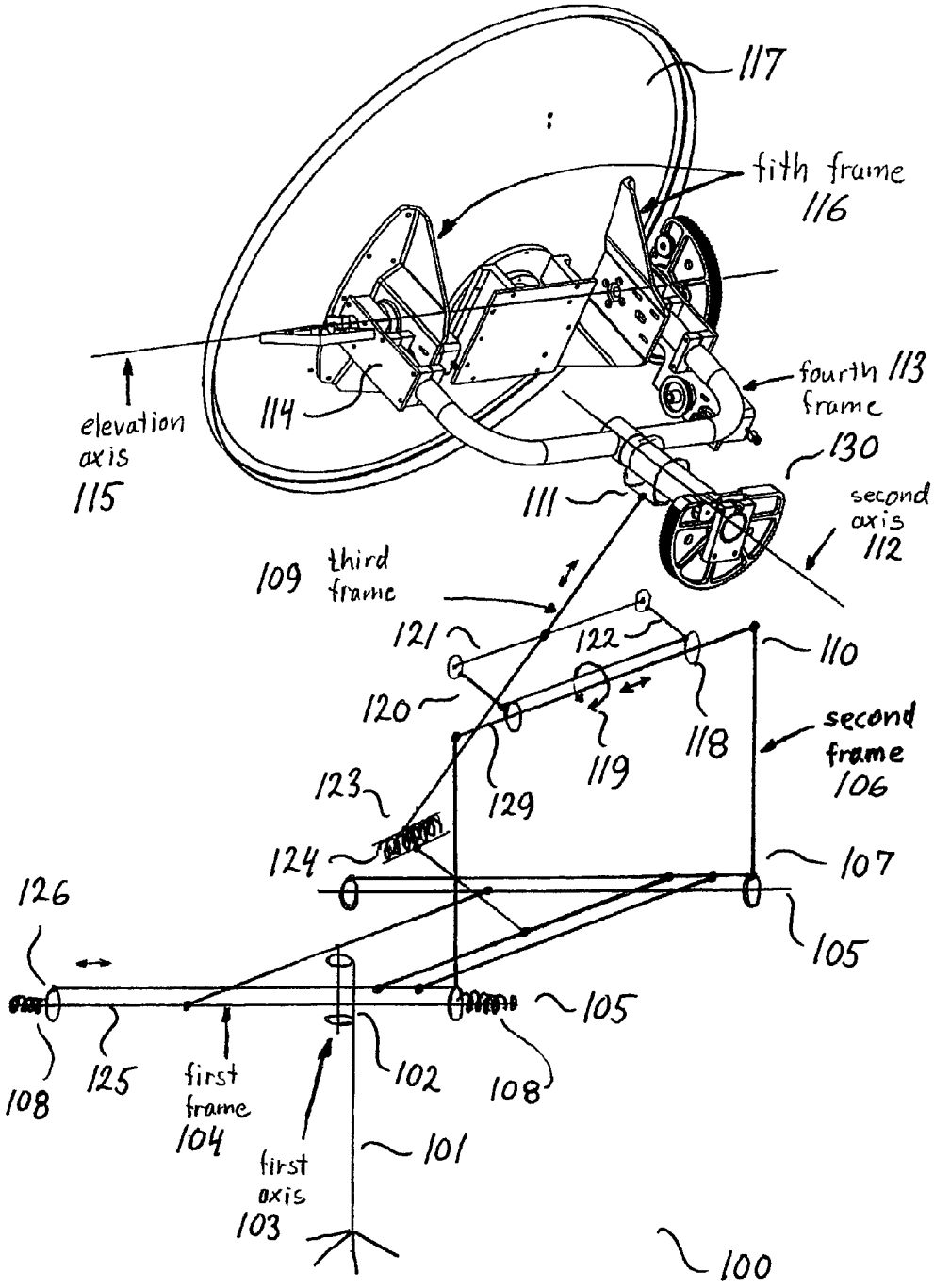
FIG. 1 is a schematic drawing showing the principles of a three-axes pedestal system according to an embodiment of the present invention.

In Table 1 is given a list of designations and reference numerals used in FIGS. 1-10.

TABLE 1. LIST OF DESIGNATIONS

100: "three-axes pedestal";
101: "base support";
102: "azimuth axis support of base support";
103: "first axis or azimuth axis";
104: "first frame";
105: "first horizontal linear bearing assembly";
106: "second frame";
107: "lower frame part of second frame";
108: "dampers or suspension members of first linear bearing assembly;
109: "third frame";
110: "upper part of second frame";
111: "cross-elevation axis support of third frame";
112: "second axis or cross-elevation axis";
113: "fourth frame";
114: "elevation axis support of fourth frame";
115: "third axis or elevation axis";
116: "fifth frame";
117: "tracking antenna";
118: "second linear bearing assembly";
119: "rotation axis provided by the second linear bearing assembly for rotation of the third frame and the second axis";
120: "sub frame interconnecting the third frame and the second linear bearing assembly";
121: "vibration isolation axis being parallel to the rotation axis 119 provided by the second linear bearing assembly";
122: "sub frame bearing connector";
123: "vibration isolation assembly interconnecting the second frame and the third frame";
124: "dampening and/or suspension member of the vibration isolation assembly 123";
125: "sliding guide of the first linear bearing assembly";
126: "sliding opening for receiving sliding guide 125";
127: "first driven gear or pulley of the base support";
128: "azimuth-axis drive motor and part of gear of the first frame";
129: "sliding and rotation guide of the second linear bearing assembly";
130: "second driven gear or pulley of the fourth frame";
131: "cross-elevation-axis drive motor of the third frame";
132: "third driven gear or pulley of the fifth frame";
133: "elevation-axis drive motor of the fourth frame"; and
134: "sliding opening 134 for receiving sliding and rotation guide 129".

Figure 9:
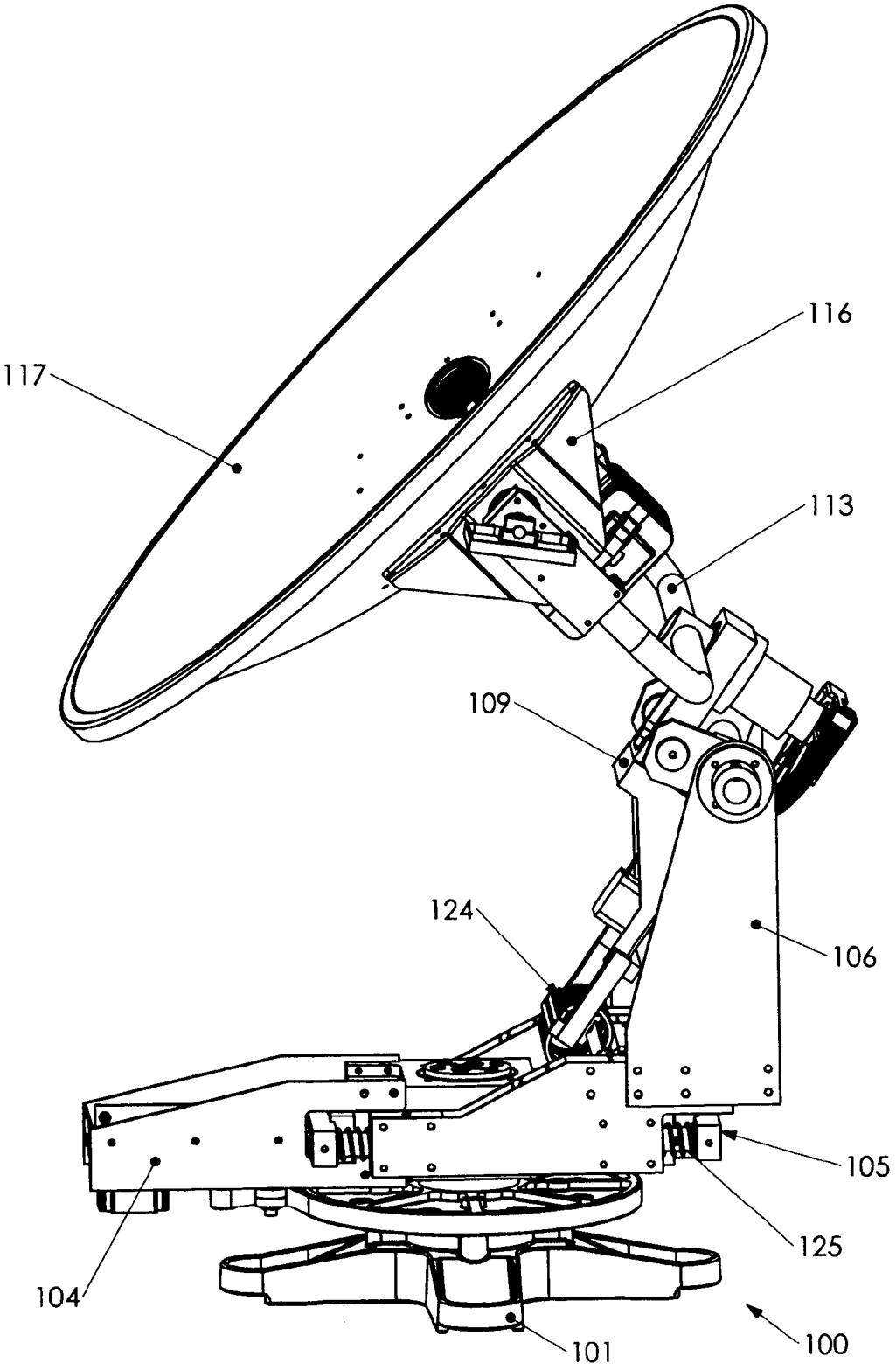
FIG. 9 is a side view of a three-axes pedestal system supporting a tracking antenna according to an embodiment of the present invention.
Figure 10:
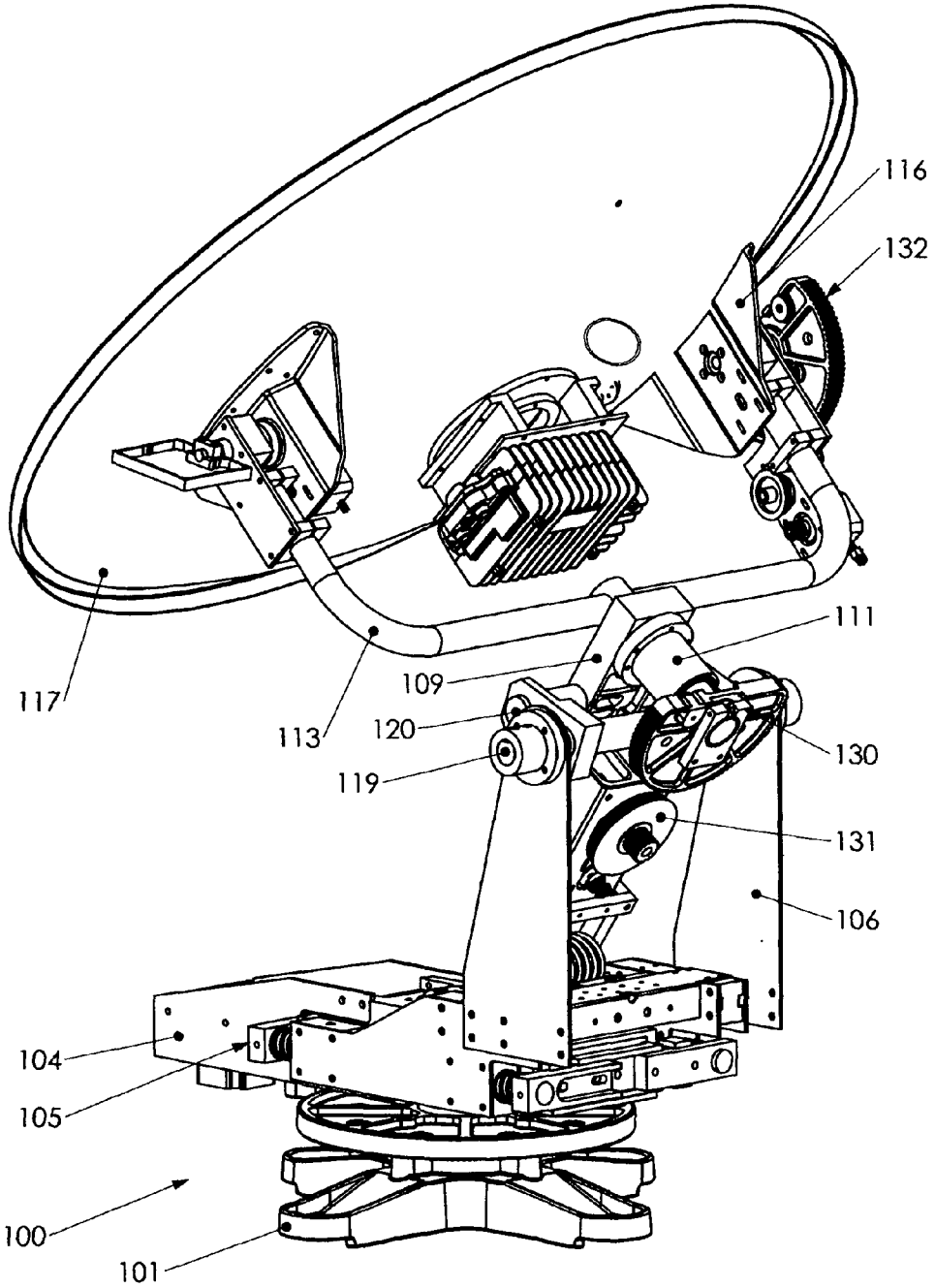
FIG. 10 is a back view of a three-axes pedestal system supporting a tracking antenna according to an embodiment of the present invention.

FIGS. 1, 9 and 10 show a satellite communication antenna 117 fitted to a three-axes pedestal 100, which may be adapted to be mounted on top of a mast of a vessel having a satellite communication terminal. Omitted from FIGS. 1, 9 and 10 is a covering radome, which is normally used for protection of such apparatus. The communication terminal may contain communications equipment and other equipment for commanding the antenna to point toward the satellite in elevation and azimuth coordinates. Operating on the pedestal 100 in addition to those antenna pointing commands may be a servo-type stabilization control system, which may be integrated with the pedestal assembly 100. The servo control system, through sensors and electronic signal processor and motor controller, acts to achieve antenna stabilization by activating drive means, such as drive motors 128, 131, 133, for each respective axis 103, 112, 115, which drive means are responsive to stabilizing control signals received from the servo control system. Such servo control systems are known in the art, and the function of theses servo control systems are beyond the scope of the present description.

FIG. 1 is a schematic drawing showing the principles of a three-axes pedestal system 100 according to a preferred embodiment of the present invention. The three-axes pedestal 100 of FIG. 1 may be used for stabilizing the pointing of a mobile tracking antenna 117 arranged at the top of the pedestal 100. The pedestal system 100 of FIG. 1 comprises a base support 101 holding an azimuth axis support 102 having a centerline defining a first axis or azimuth axis 103. A first frame 104 is rotatably mounted on the azimuth axis support 102 to rotate about the first axis 103, and the first frame 104 holds part of a first horizontal linear bearing assembly 105. A second frame 106 having a lower frame part 107 is slidably interconnected to the first frame 104 via the first horizontal linear bearing assembly 105. The first linear bearing assembly 105 includes dampers or suspension members 108 for dampening linear slide movement of the second frame 106 along the first linear bearing assembly 105 and thereby for dampening the relative movement of the second frame 106 to the first frame 104. A third frame 109 is interconnected to an upper part 110 of the second frame 106, and the third frame 109 holds a cross-elevation axis support 111 having a centerline defining a second axis or cross-elevation axis 112. A fourth frame 113 is rotatably mounted on the cross-elevation axis support 111 of the third frame 109 to rotate about the second axis 112, and the fourth frame 113 holds an elevation axis support 114, which have a centerline defining a third axis or elevation axis 115. A fifth frame 116 supports the tracking antenna 117, where the fifth frame 116 is rotatably mounted on the elevation axis support 114 of the fourth frame 113 to rotate about the third axis 115.

The third frame 109 with the cross-elevation axis support 111 and the fourth frame 113 with the elevation axis support 114 are designed and arranged in order to have the cross-elevation axis 112 and the elevation axis 115 being substantially perpendicular to each other.

From FIG. 1 it is seen that first linear bearing assembly 105 is positioned on the first frame 104 so that the direction of the linear slide movement of the second frame 106 along the first linear bearing assembly 105 is substantially perpendicular to the first axis 103.

The upper part 110 of the second frame 106 holds a second linear bearing assembly 118, and the third frame 109 is slidably interconnected to the second frame 106 via the second linear bearing assembly 118. The second linear bearing assembly 118 is a horizontal linear bearing assembly designed and arranged so that it provides a direction of linear slide movement for the third frame 109, which direction of linear slide movement is substantial perpendicular to the second axis 112, and which direction of linear slide movement is also substantially perpendicular to the direction of linear movement of the second frame 106 along the first linear bearing assembly 105. Furthermore, the direction of linear slide movement of the third frame 109 is substantially perpendicular to the first axis 103.

The arrangement of the first linear bearing assembly 105 interconnecting the first frame 104 and the second frame 106, 107 may enable horizontal linear movements of the second frame 106 along the axis of the first linear bearing assembly 105 without changing or affecting the direction of the second axis (cross-elevation axis) 112 and the third axis (elevation axis) 115. Such horizontal linear movements of the second frame 106 may help to isolate the antenna 117 from shock and vibration received by the base 101 of the pedestal 100.

The second linear bearing assembly 118 is also designed and arranged to provide an axis for rotation 119 of the third frame 109 and the second axis 112 in a plane perpendicular to the direction of the linear slide movement provided by the second linear bearing assembly 118 for the third frame 109. Thus, the third frame 109 is both slidably and rotatably interconnected to the second linear bearing assembly 118. The second linear bearing assembly 118 comprises an elongated and horizontally arranged sliding and rotation guide or rail 129, which is fixedly mounted on the upper part of the second frame 106, and which define the rotation axis 119.

In the preferred embodiment the pedestal 100 also comprises a sub frame 120 interconnecting the third frame 109 and the second linear bearing assembly 118. This sub frame 120 may be slidably and rotatably connected to the second linear bearing assembly 118 to provide the slidably and rotatably interconnection of the third frame 109 to the second linear bearing assembly 118. The third frame 109 may be rotatably mounted to the sub frame 120 for rotation about a vibration isolation axis 121, which is parallel to the rotation axis 119 provided by the second linear bearing assembly 118. The sub frame 120 may comprise one or more bearing connectors 122, which may be slidably and rotatably mounted to the second linear bearing assembly 118, and the third frame 109 may then be rotatably mounted to the one or more bearing connectors 122 to rotate about the vibration isolation axis 121.

The reason to have the arrangement of the interconnection between the second frame 106 and the third frame 109 being performed by the second linear bearing assembly 118 and the sub frame 120, is to better isolate the antenna 117 from shock and vibration received by the base 101 of the pedestal 100. However, in order for this arrangement to work properly, a vibration isolation assembly 123 is arranged for interconnecting a lower part of the second frame 106 with a lower part of the third frame 109. The vibration isolation assembly 123 comprises a dampening and/or suspension member 124, where a lower part of the second frame 106 and a lower part of the third frame are connected to each other via said dampening or suspension member 124. It is preferred that the dampening or suspension member 124 is of a wire rope type.

The arrangement of the second linear bearing assembly 118, which allows linear and rotating movements of the third frame 109 with its sub frame 120 in relation to the second frame 106, and the use of the wire robe type suspension member 124 for supporting and suspending the third frame 109 including the sub frame 120 in relation to the second frame 106, combined with the use of a linear horizontal movement of the second frame 107, makes it possible for the third frame 109 including the sub frame 120 to perform movements in a vertical direction substantial parallel to the azimuth axis 103, and further to perform movements in a horizontal direction along the rotation axis 119 provided by the second linear bearing assembly, in such a way that the pointing direction of the second and third axes 112, 115 are at least partly isolated from and unaffected by any vibration or shock movement being imposed on the base support 101 from any direction.

In order to enable horizontal linear movements of the second frame 106 along the axis of the first linear bearing assembly 105, it is preferred that the first linear bearing assembly 105 comprises two elongated and parallel and horizontally arranged sliding guides or rails 125 received within complementary shaped sliding openings 126 of the lower part of the second frame 107. The dampers 108 of the first linear bearing assembly 105 may include one or more damping springs, and for the herein described embodiment, two damping springs are arranged on one of the sliding guides 125 of the first linear bearing assembly, 105 one on each side of the corresponding sliding opening 126 of the lower frame part 107 of the second frame 106.

Figure 2:
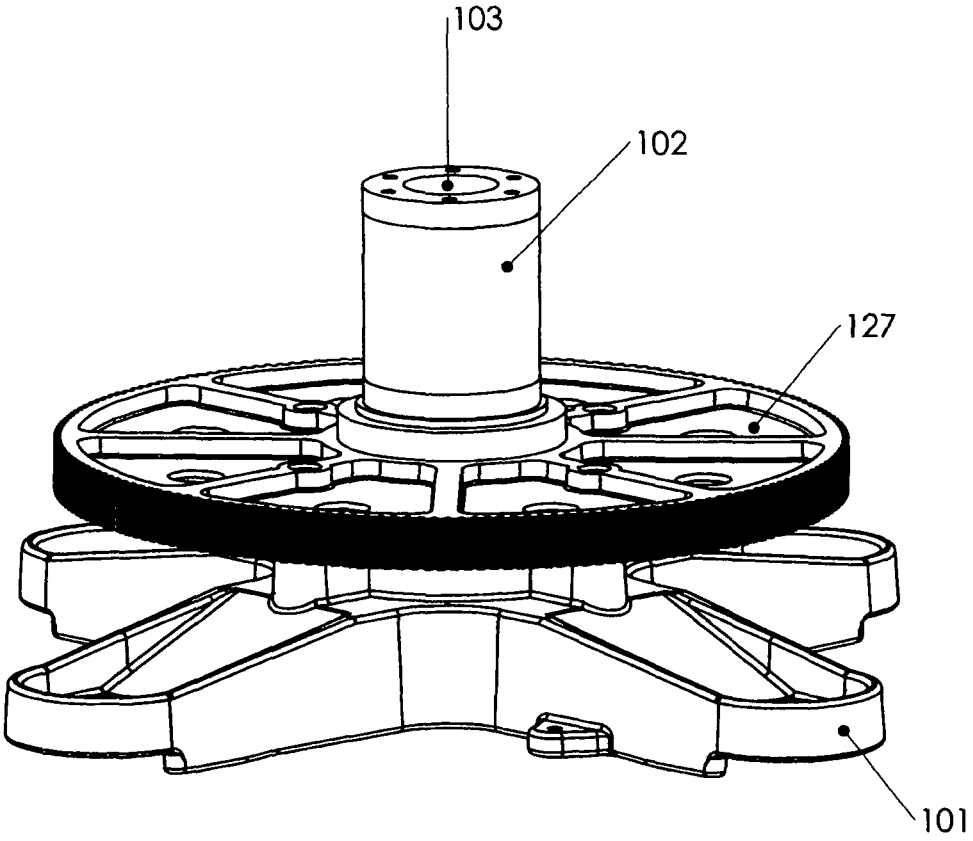
FIG. 2 shows an embodiment of a base support being part of a three-axes pedestal system according to the present invention.
Figure 3:
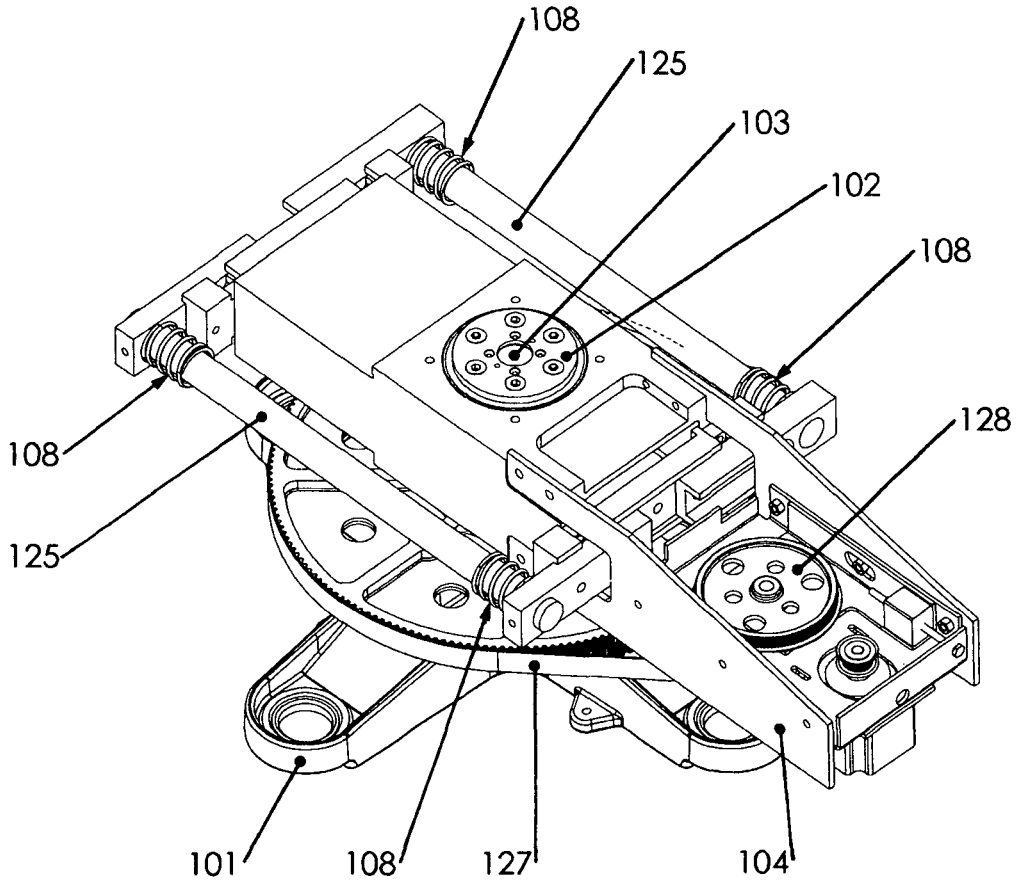
FIG. 3 shows an embodiment of a first frame being part of a three-axes pedestal system according to the present invention where the first frame is mounted on the base support of FIG. 2.

In order for a servo control system to control rotation of the first, fourth, and fifth frames, 104, 113, 116, around the three axes, azimuth axis, cross-elevation axis, and elevation axis, 103, 112, 115, respectively, corresponding gear systems and drive motors may be arranged at the pedestal 100. For the pedestal 100 illustrated in FIGS. 1-10, the base support 101 holds a first driven gear or pulley 127 arranged concentric about the first axis or azimuth axis 103, and the first frame 104 holds an azimuth-axis drive motor 128 operably connected to the driven gear or pulley 127, which is illustrated in FIGS. 2 and 3. The fourth frame 113 holds a second driven gear or pulley 130 arranged concentric about the second axis or cross-elevation axis 112, and the third frame 109 holds a cross-elevation-axis drive motor 131 operably connected to the second driven gear or pulley 130, which is illustrated in FIGS. 5 and 10. The fifth frame 116 holds a third driven gear or pulley 132 arranged concentric about the third axis or elevation axis 115, and the fourth frame 113 comprises an elevation-axis drive motor 133 operably connected to the third driven gear or pulley, which is illustrated in FIG. 8.

To better understand the principle of construction of the pedestal 100 of the present invention, embodiments for different parts of the pedestal 100 are illustrated in FIGS. 2-8.

FIG. 2 shows an embodiment for a base support 101, where the base support has an azimuth axis support 102 having a centerline defining a first axis or azimuth axis 103. The base support 101 further holds a first driven gear or pulley 127 to be driven by an azimuth-axis drive motor 128 as shown in FIG. 3

FIG. 3 shows an embodiment of the first frame 104, where the first frame 104 is mounted on the base support 101 of FIG. 2. The first frame 104 is rotatably mounted on the azimuth axis support 102 to rotate about the first axis 103, and the first frame 104 holds two sliding guides 125 being part of the first horizontal linear bearing assembly 105. One of the sliding guides 125 holds two springs as dampers or suspension members 108 for dampening linear slide movement of the second frame 106 along the sliding guides 125.

Figure 4:
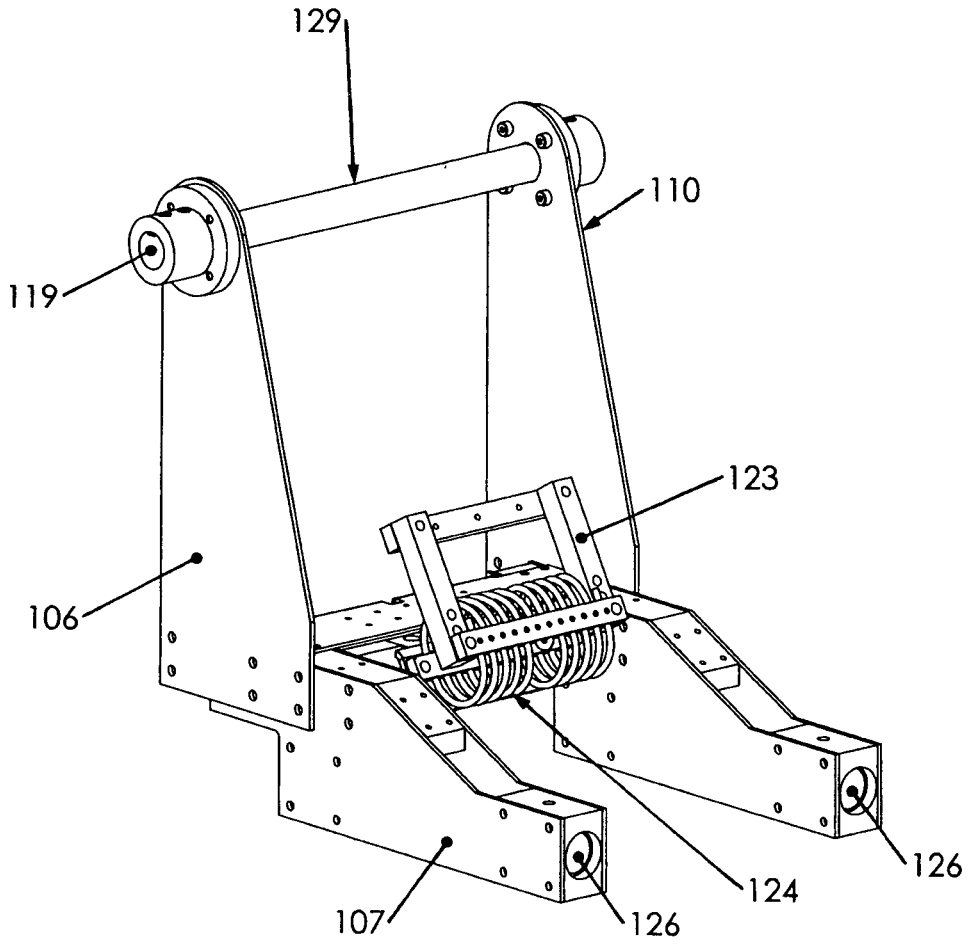
FIG. 4 shows an embodiment of a second frame being part of a three-axes pedestal system according to the present invention.
Figure 5:
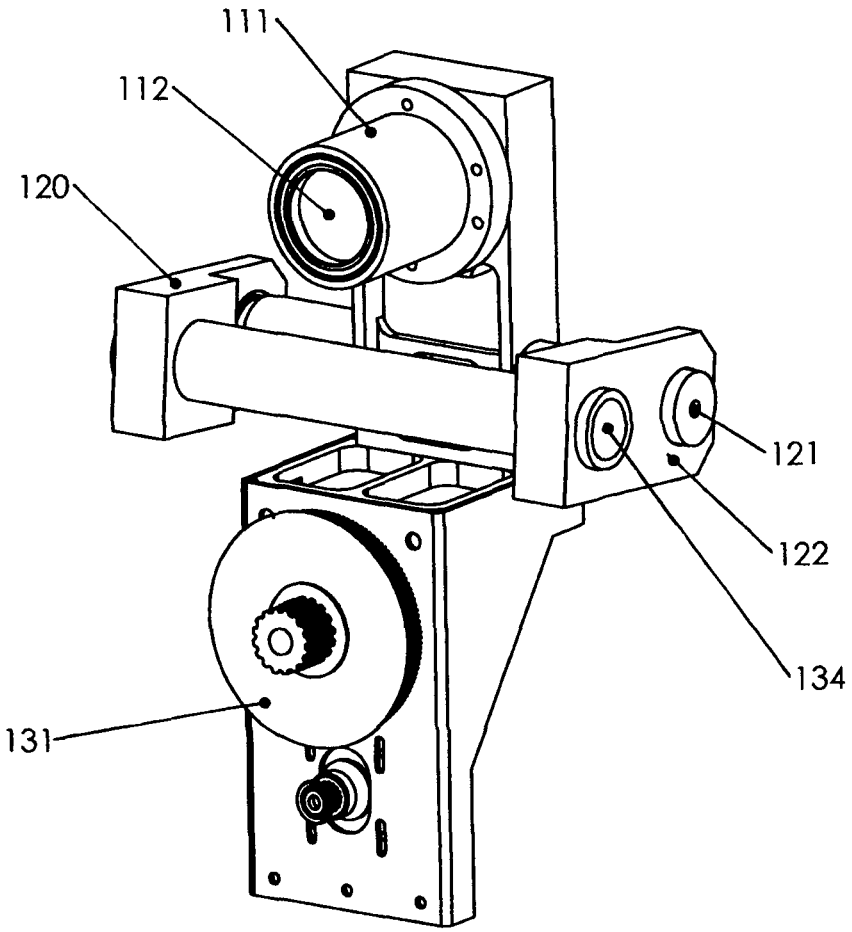
FIG. 5 shows an embodiment of a third frame being part of a three-axes pedestal system according to the present invention.

FIG. 4 shows an embodiment of the second frame 106, where the second frame 106 has a lower frame part 107 holding two parallel sliding openings 126 being part of the first linear bearing assembly 105 and being designed for receiving the sliding guides 125 of the first frame 104. The second frame 106 has an upper part 110 holding the sliding and rotation guide 129 being part of the second linear bearing assembly 118. The guide 129 defines the rotation axis 119. FIG. 4 also shows a vibration isolation assembly 123 for connecting the lower part of the second frame 107 with the lower part of the third frame 109. The vibration isolation assembly 123 comprises a wire rope type dampening and/or suspension member 124 for the connection of the lower part of the second frame 107 with the lower part of the third frame 109.

FIG. 5 shows an embodiment of the third frame 109, where the third frame 109 holds a cross-elevation axis support 111 having a centerline defining the second axis or cross-elevation axis 112. The third frame 109 is connected to the sub frame 120, which is arranged for interconnecting the third frame 109 and the second linear bearing assembly 118. This sub frame 120 has a sliding opening 134 fitted to be slidably and rotatably connected to the sliding and rotation guide 129 to provide the slidably and rotatably interconnection of the third frame 109 to the second linear bearing assembly 118. The sliding opening 134 may thus be seen as part of the second linear bearing assembly 118.

The sub frame 120 has two bearing connectors 122, which at one end are mounted to a part defining the sliding opening 134, to thereby be slidably and rotatably mounted to the guide 129, and the third frame 109 is rotatably mounted to the other end of the bearing connectors 122 to rotate about the vibration isolation axis 121, which is parallel to the rotation axis 119 provided by the sliding and rotation guide 129. The third frame 109 also holds a cross-elevation-axis drive motor 131 and gear, which may be operably connected to the second driven gear or pulley 130 as shown in FIG. 10

Figure 6:
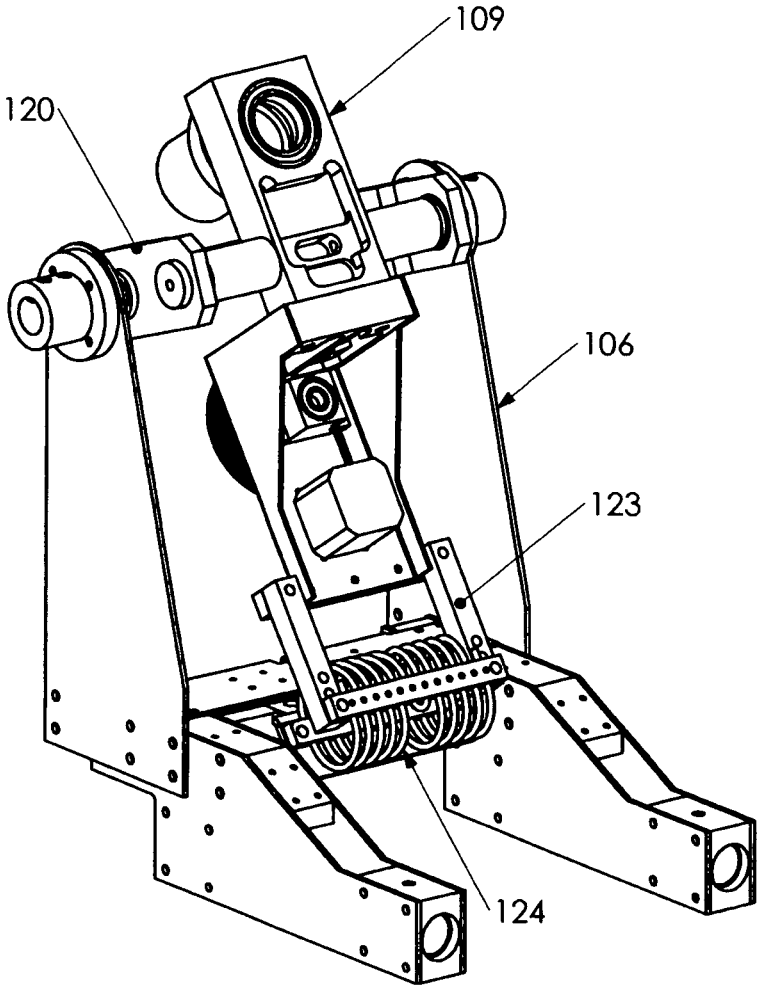
FIG. 6 shows the third frame of FIG. 5 being connected to the second frame of FIG. 4 according to an embodiment of the present invention.

FIG. 6 shows the third frame 109 of FIG. 5 being connected to the second frame 106 of FIG. 4. For the upper parts of the frames, the third frame 109 is interconnected to the second frame 106 via the sub frame 120 and the second linear bearing assembly 118 with the sliding and rotation guide 129, and for the lower part of the frames, the third frame 109 is connected to the second frame 106 via the wire rope type a dampening and/or suspension member 124, which is part of the vibration and isolation assembly 123.

Figure 7:
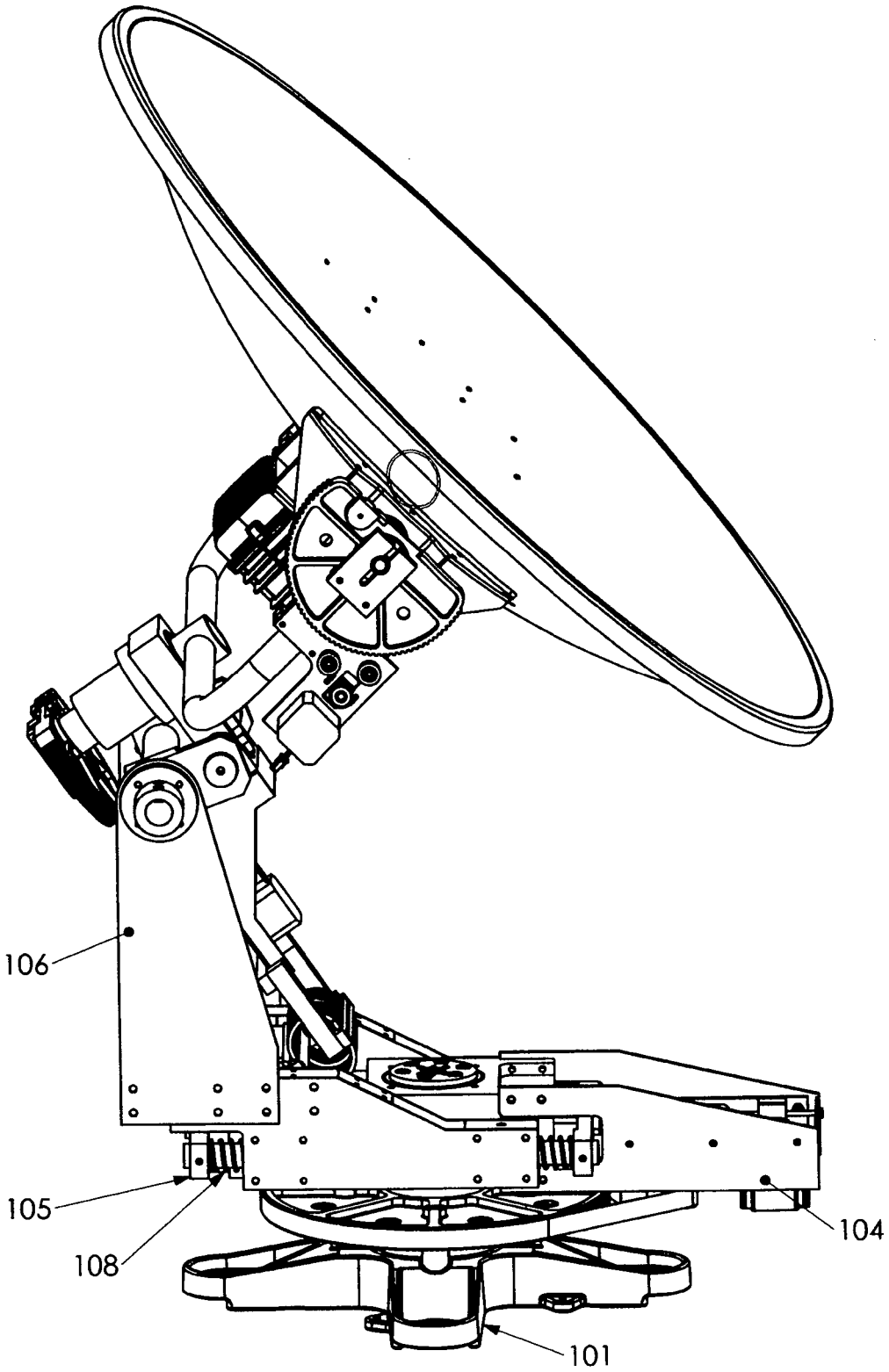
FIG. 7 shows the second frame of FIG. 4 being mounted to the first frame of FIG. 3 according to an embodiment of the present invention.
Figure 8:
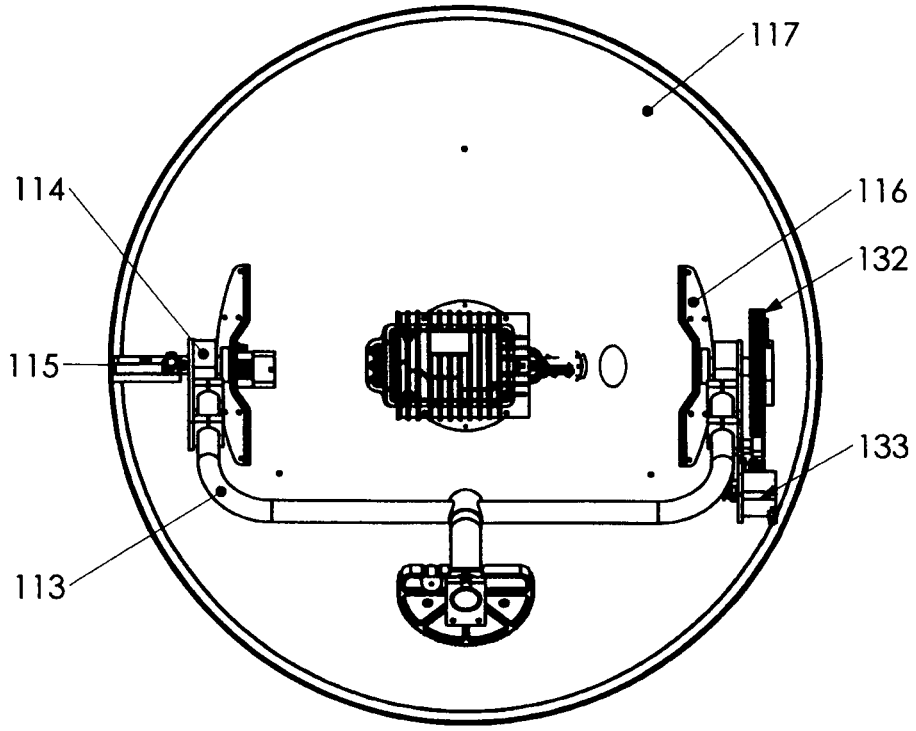
FIG. 8 shows an embodiment of a fourth frame and a fifth frame being part of a three-axes
Pedestal system according to the present invention where the fifth frame is mounted to the fourth frame and supports a tracking antenna.

FIG. 7 shows the lower part 107 of second frame 106 of FIG. 4 being connected to the first frame 104 of FIG. 3 via the two sliding guides 125 of the first linear bearing assembly 105. Two springs 108 are arranged on one of the sliding guides 125 for dampening linear slide movement of the second frame 106 along the sliding guides 125.

FIG. 8 shows the fifth frame 116 being connected to the fourth frame 113, where the fifth frame 116 is supporting a tracking antenna 117. The fourth frame 113, which can be rotatably mounted on the cross-elevation axis support 111 of the third frame 109 to rotate about the second axis 112, holds an elevation axis support 114, which have a centerline defining the third axis or elevation axis 115. The fifth frame 116 is rotatably mounted on the elevation axis support 114 of the fourth frame 113 to rotate about the third axis 115.

The fourth frame 113 may hold a second driven gear or pulley 130 arranged concentric about the second axis or cross-elevation axis 112 to be operatively connected to the cross-elevation-axis drive motor 131 of the third frame 109, see FIG. 10. The fifth frame 116 also holds a third driven gear or pulley 132 arranged concentric about the third axis or elevation axis 115, and the fourth frame 113 further comprises the elevation-axis drive motor 133, which is operably connected to the third driven gear or pulley 132.

FIG. 9 is a side view of the three-axes pedestal system 100 supporting a tracking antenna 117. The reference numerals of FIG. 9 refer to the list of Table 1.

FIG. 10 is a back view of the three-axes pedestal system 100 supporting a tracking antenna 117. The reference numerals of FIG. 10 refer to the list of Table 1.

It shall be understood that the basic principles of the present invention as described in the appending claims can be realized in many other ways than that shown and illustrated in FIGS. 1-10. The realization shown in FIG. 1 through FIG. 10 will however constitute a very beneficial design and solution for the problems of stabilizing high gain antennas on a small ship in rough sea. Other solutions and specially solutions involving simplified mechanics may be utilized in less demanding applications such as "mobile terminals" operating in small regional areas of the earth and/or exposed to only very limited ships motion (vehicle motion).

The invention claimed is:

1. A three-axes pedestal for stabilizing the pointing of a mobile tracking antenna, said pedestal comprising:

a base support with an azimuth axis support having a centerline defining a first axis or azimuth axis;

a first frame being rotatably mounted on the azimuth axis support to rotate about the first axis, said first frame holding at least part of a first horizontal linear bearing assembly;

a second frame with a lower frame part slidably interconnected to the first frame via the first horizontal linear bearing assembly, said first linear bearing assembly including dampers or suspension members for dampening linear slide movement of the second frame along the first linear bearing assembly and thereby for dampening the relative movement of the second frame to the first frame;

a third frame interconnected to an upper part of the second frame, said third frame holding a cross-elevation axis support with a centerline defining a second axis or cross-elevation axis;

a fourth frame being rotatably mounted on the cross-elevation axis support of the third frame to rotate about the second axis, said fourth frame holding an elevation axis support with a centerline defining a third axis or elevation axis; and a fifth frame supporting the tracking antenna and being rotatably mounted on the elevation axis support of the fourth frame to rotate about the third axis;

wherein the upper part of the second frame holds a second linear bearing assembly being a horizontal linear bearing assembly, and wherein the third frame is interconnected to the second frame via the second linear bearing assembly, with the second linear bearing assembly providing a direction of linear oscillation for the third frame, said direction of linear oscillation of the third frame being substantially horizontal relative to the second frame and substantially perpendicular to the first axis.

2. A pedestal according to claim 1, wherein the direction of the linear slide movement of the second frame along the first linear bearing assembly is substantially perpendicular to the first axis.

3. A pedestal according to claim 1, wherein the third frame is interconnected to the second linear bearing assembly with the second linear bearing assembly providing an axis for rotational oscillation of the third frame and the second axis in a plane perpendicular to the direction of the linear oscillation provided by the second linear bearing assembly.

4. A pedestal according to claim 3, further comprising a sub frame interconnecting the third frame and the second linear bearing assembly, said sub frame being connected to the second linear bearing assembly to provide the interconnection of the third frame to the second linear bearing assembly.

5. A pedestal according to claim 4, wherein the third frame is mounted to the sub frame for rotational oscillation about a vibration isolation axis being parallel to the rotational oscillation axis provided by the second linear bearing assembly.

6. A pedestal according to claim 5, wherein the sub frame comprises one or more bearing connectors being mounted to the second linear bearing assembly, and wherein the third frame is mounted to the one or more bearing connectors for rotational oscillation about said vibration isolation axis.

7. A pedestal according to claim 1, wherein the upper part of the second frame holds the second linear bearing assembly, with the third frame being interconnected to the second frame via said second linear bearing assembly, and with the second linear bearing assembly providing the direction of linear oscillation and an axis of rotational oscillation for the third frame, thereby providing an axis of rotational oscillation for the second axis in a plane perpendicular to the direction of linear oscillation provided by the second linear bearing assembly.

8. A pedestal according to claim 1, wherein the direction of linear oscillation of the third frame along the second linear bearing assembly is substantially perpendicular to the direction of linear movement of the second frame along the first linear bearing assembly.

9. A pedestal according to claim 1, further comprising a vibration isolation assembly interconnecting the second frame and the third frame.

10. A pedestal according to claim 9, wherein the vibration isolation assembly comprises a dampening and/or suspension member with the second and third frames being connected via said dampening or suspension member.

11. A pedestal according to claim 10, wherein the dampening or suspension member interconnecting the second and third frames is of a wire rope type.

12. A pedestal according to claim 1, wherein the first linear bearing assembly comprises two elongated and parallel and horizontally arranged sliding guides or rails received within complementary shaped sliding openings of the lower part of the second frame.

13. A pedestal according to claim 12, wherein two damping springs are arranged on at least one of the sliding guides of the first linear bearing assembly, one on each side of the sliding opening of the lower frame part of the second frame.

14. A pedestal according to claim 1, wherein the dampers of the first linear bearing assembly include one or more damping springs.

15. A pedestal according to claim 1, wherein the base support further holds a first driven gear or pulley arranged concentric about the first axis or azimuth axis, and the first frame further holds an azimuth-axis drive motor operably connected to the driven gear or pulley.

16. A pedestal according to claim 15, wherein the azimuth-axis drive motor is a stepper motor.

17. A pedestal according to claim 1, wherein the second linear bearing assembly comprises an elongated and horizontally arranged sliding and rotation guide or rail fixedly mounted on the upper part of the second frame.

18. A pedestal according to claim 1, wherein the fourth frame holds a second driven gear or pulley arranged concentric about the second axis or cross-elevation axis, and the third frame holds a cross-elevation-axis drive motor operably connected to the second driven gear or pulley.

19. A pedestal according to claim 18, wherein the cross-elevation axis drive motor is a stepper motor.

20. A pedestal according to claim 1, wherein the fifth frame holds a third driven gear or pulley arranged concentric about the third axis or elevation axis, and the fourth frame comprises an elevation-axis drive motor operably connected to the third driven gear or pulley.

21. A pedestal according to claim 20, wherein the elevation-axis drive motor is a stepper motor.

22. A three-axes pedestal for stabilizing the pointing of a mobile tracking antenna, said pedestal comprising:

a base support with an azimuth axis support having a centerline defining a first axis or azimuth axis;

a first frame being rotatably mounted on the azimuth axis support to rotate about the first axis, said first frame holding at least part of a first horizontal linear bearing assembly;

a second frame with a lower frame part slidably interconnected to the first frame via the first horizontal linear bearing assembly, said first linear bearing assembly including dampers or suspension members for dampening linear slide movement of the second frame along the first linear bearing assembly and thereby for dampening the relative movement of the second frame to the first frame;

a third frame interconnected to an upper part of the second frame, said third frame holding a cross-elevation axis support with a centerline defining a second axis or cross-elevation axis;

a fourth frame being rotatably mounted on the cross-elevation axis support of the third frame to rotate about the second axis, said fourth frame holding an elevation axis support with a centerline defining a third axis or elevation axis; and a fifth frame supporting the tracking antenna and being rotatably mounted on the elevation axis support of the fourth frame to rotate about the third axis;

wherein the upper part of the second frame holds a second linear bearing assembly, with the third frame being interconnected to the second frame via said second linear bearing assembly, and with the second linear bearing assembly providing a direction of linear oscillation and an axis of rotational oscillation for the third frame, thereby providing an axis of rotational oscillation for the second axis in a plane perpendicular to the direction of linear oscillation provided by the second linear bearing assembly.

23. A three-axes pedestal for stabilizing the pointing of a mobile tracking antenna, said pedestal comprising:

a base support with an azimuth axis support having a centerline defining a first axis or azimuth axis;

a first frame being rotatably mounted on the azimuth axis support to rotate about the first axis, said first frame holding at least part of a first horizontal linear bearing assembly;

a second frame with a lower frame part slidably interconnected to the first frame via the first horizontal linear bearing assembly, said first linear bearing assembly including dampers or suspension members for dampening linear slide movement of the second frame along the first linear bearing assembly and thereby for dampening the relative movement of the second frame to the first frame;

a third frame interconnected to an upper part of the second frame, said third frame holding a cross-elevation axis support with a centerline defining a second axis or cross-elevation axis;

a fourth frame being rotatably mounted on the cross-elevation axis support of the third frame to rotate about the second axis, said fourth frame holding an elevation axis support with a centerline defining a third axis or elevation axis; and a fifth frame supporting the tracking antenna and being rotatably mounted on the elevation axis support of the fourth frame to rotate about the third axis;

wherein the upper part of the second frame holds a second linear bearing assembly being a horizontal linear bearing assembly, and wherein the third frame is interconnected to the second frame via the second linear bearing assembly, with the second linear bearing assembly providing a direction of linear oscillation for the third frame, said direction of linear oscillation of the third frame being substantially perpendicular to the first axis; and wherein the third frame is interconnected to the second linear bearing assembly with the second linear bearing assembly providing an axis for rotational oscillation of the third frame and the second axis in a plane perpendicular to the direction of the linear oscillation provided by the second linear bearing assembly.

* * * * *